US008020836B2

(12) United States Patent
Bishop

(10) Patent No.: US 8,020,836 B2
(45) Date of Patent: Sep. 20, 2011

(54) SECURITY BARRIER

(75) Inventor: Justin Bishop, West Caldwell, NJ (US)

(73) Assignee: Halo Maritime Defense Systems, Inc., Andover, MA (US)

( * ) Notice: Subject to any disclaimer, the term of this patent is extended or adjusted under 35 U.S.C. 154(b) by 676 days.

(21) Appl. No.: 11/879,273

(22) Filed: Jul. 16, 2007

(65) Prior Publication Data

US 2010/0059728 A1 Mar. 11, 2010

Related U.S. Application Data

(60) Provisional application No. 60/831,118, filed on Jul. 14, 2006.

(51) Int. Cl.
*E02B 3/00* (2006.01)

(52) U.S. Cl. ..... 256/13; 256/23; 114/240 R; 405/26

(58) Field of Classification Search ..... 256/13, 256/23; 405/21, 25–27, 30; 114/240 A, 114/240 B, 240 D, 240 R
See application file for complete search history.

(56) References Cited

U.S. PATENT DOCUMENTS

| | | | | | |
|---|---|---|---|---|---|
| 1,151,607 | A * | 8/1915 | Newhall et al. | 114/241 |
| 1,744,834 | A * | 1/1930 | Maynard | 114/221 R |
| 2,369,464 | A * | 2/1945 | Kalnitz | 114/240 R |
| 2,383,095 | A * | 8/1945 | Wallace | 114/241 |
| 2,693,161 | A * | 11/1954 | Stubbs | 405/71 |
| 3,357,192 | A * | 12/1967 | Hibarger | 405/27 |
| 3,614,844 | A * | 10/1971 | Withers | 49/170 |
| 3,864,049 | A * | 2/1975 | Ono | 403/171 |
| 4,033,137 | A * | 7/1977 | Geist | 405/71 |
| 4,104,884 | A * | 8/1978 | Preus | 405/68 |
| 4,174,185 | A * | 11/1979 | Toki | 405/27 |
| 4,272,214 | A * | 6/1981 | Nyfeldt et al. | 405/72 |
| 4,688,024 | A * | 8/1987 | Gadde | 340/550 |
| 4,738,563 | A * | 4/1988 | Clark | 405/52 |
| 4,961,393 | A * | 10/1990 | Murray | 114/240 R |
| 6,033,151 | A * | 3/2000 | Tsou | 405/219 |
| 6,102,616 | A * | 8/2000 | Foote | 405/26 |
| 6,443,653 | B1 * | 9/2002 | Zingale | 405/76 |
| 6,591,774 | B2 * | 7/2003 | Metherell et al. | 114/241 |
| 6,669,403 | B2 * | 12/2003 | Clark et al. | 405/30 |
| 7,140,599 | B1 * | 11/2006 | Spink | 256/13 |
| 7,401,565 | B2 * | 7/2008 | Nixon et al. | 114/241 |
| 7,524,140 | B2 * | 4/2009 | Bishop | 405/30 |
| 2003/0136325 | A1 * | 7/2003 | Wooley et al. | 114/240 R |
| 2003/0190191 | A1 * | 10/2003 | Clark | 405/26 |
| 2006/0037526 | A1 * | 2/2006 | Knezek et al. | 114/267 |

OTHER PUBLICATIONS

International Search Report issued in International Patent Application No. PCT/US2007/016132, mailed Jan. 22, 2009.

* cited by examiner

*Primary Examiner* — Joshua T Kennedy
(74) *Attorney, Agent, or Firm* — McDermott Will & Emery LLP

(57) ABSTRACT

A security barrier for use in a water location includes a plurality of barrier units, each having a plurality of individual panels; toppers attached between the barrier units for connecting the barrier units to one another and for disengaging the barrier units from one another when an impact occurs on the security barrier; butt plates attached between the toppers; a rope and a tube containing the rope for connecting individual panels; and a vertical pin for engaging the toppers and the butt plates.

5 Claims, 9 Drawing Sheets

103
100

100

100
110

100

100

100

105

105

105

105

SECURITY BARRIER

CROSS REFERENCES TO RELATED APPLICATIONS

This application claims the benefit of U.S. Provisional Application Ser. No. 60/831,118, filed Jul. 14, 2006, the contents of which are hereby incorporated by reference herein in their entirety.

FIELD OF THE INVENTION

Embodiments of this invention include a security system/barrier for use on water and/or land, preferably deployed on water, and describe an improved apparatus and method for this purpose.

Countering Terrorism.

This invention may be utilized in countering terrorism. Unwelcome objects, such as land and sea vehicles, attempting to intrude into populated, secure, or sensitive areas are commonly employed in terrorist activities. As part of efforts to counter terrorism, there is an urgent need to prevent penetration of such objects into such populated, secure, or sensitive area. One or more embodiments of this invention will aid in this prevention.

BACKGROUND OF THE INVENTION

This invention concerns a security system/barrier on water and/or land, preferably deployed on water.

Structures for use on both land and/or water as security systems/barriers are well known in the art. Such structures, intended to stop intruding objects, range from thick, solid walls blocking the object's progress to systems for disabling the propelling mechanism of the object.

Although these structures often accomplish their purpose, partially or completely, they commonly exhibit noticeable shortcomings. First, these structures may be very cumbersome and time-consuming to install and erect as and where desired. Second, they may be difficult, or even impossible, to maintain, especially to repair after they have sustained the impact of an intruding object. Third, they are often not adaptable to different needs and conditions. These and other shortcomings are well known in the relevant art.

Therefore, it is desired to have an improved security system/barrier which remains effective while overcoming such shortcomings.

BRIEF SUMMARY OF THE INVENTION

In one embodiment, this invention comprises a system for use as a security system/barrier.

In another embodiment, this invention comprises a method for using a security system/barrier.

In still another embodiment, this invention comprises apparatus for use with a security system/barrier.

A security barrier for use in a water location according to the present disclosure includes barrier units, each of which includes a plurality of individual panels; toppers for connecting the barrier units and for disengaging the barrier units from one another when an impact occurs on the security barrier; a rope and a tube containing the rope for connecting individual panels; and a vertical pin for engaging the toppers and the butt plates.

BRIEF DESCRIPTION OF THE SEVERAL VIEWS OF THE DRAWING

FIG. 1A is a top view of a security barrier, FIG. 1B is a front view of the security barrier and FIG. 1C is a side view of the security barrier according to this embodiment.

FIG. 4A is a front view of a security barrier, FIG. 4B is a top view of the security barrier and FIG. 4C is a side view of the security barrier according to this embodiment.

FIG. 5A is a side view of a butt plate, FIGS. 5B and 5C are schematic views of the butt plate and FIG. 5D is a top view of the butt plate according to this embodiment.

FIG. 6B is a back view of the topper, FIG. 6C is a side view of the topper, FIG. 6D is a front view of the topper and FIG. 6E is a top view of the topper according to this embodiment.

DETAILED DESCRIPTION OF THE INVENTION

Figure 1A:
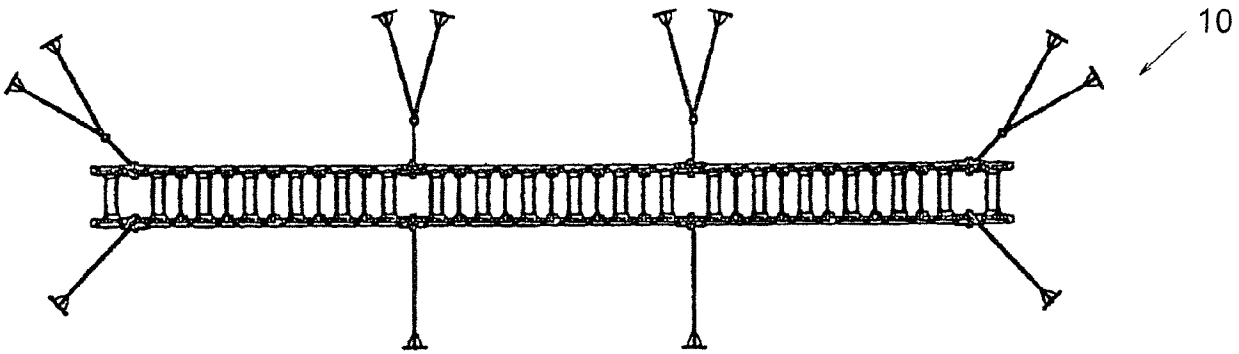
FIGS. 1A-1C are views of one embodiment of this invention.
Figure 1B:
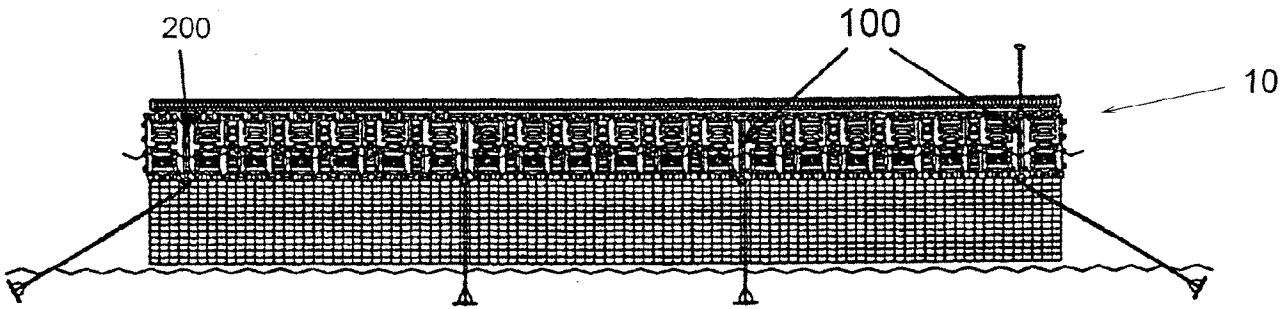
Figure 1C:
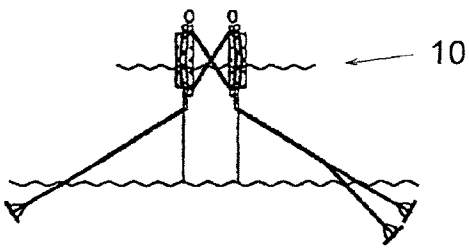
Figure 2:
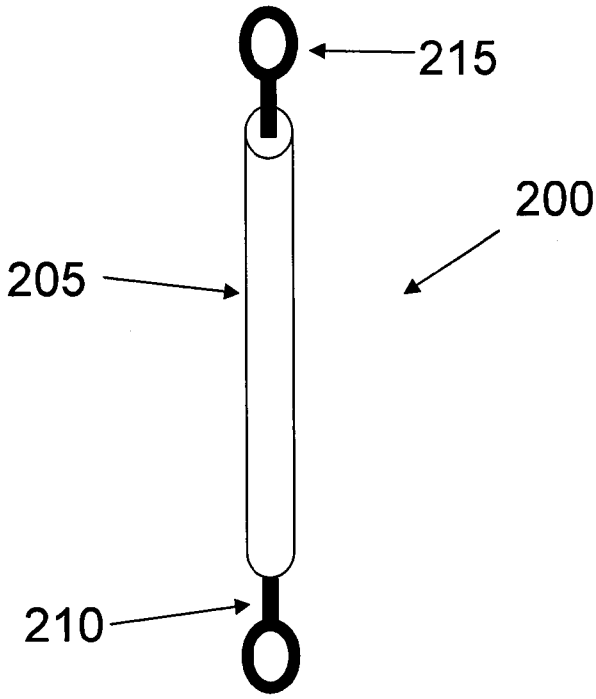
FIG. 2 is a view of a vertical pin according to one embodiment of this invention.
Figure 3:
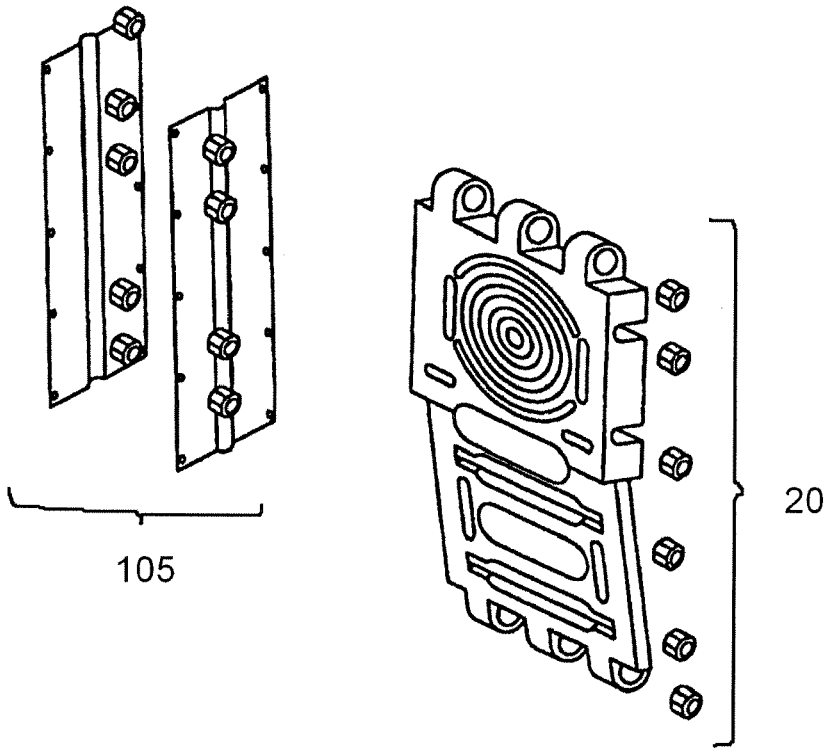
FIG. 3 is a partial exploded view of a security barrier according to one embodiment of this invention.
Figure 4B:
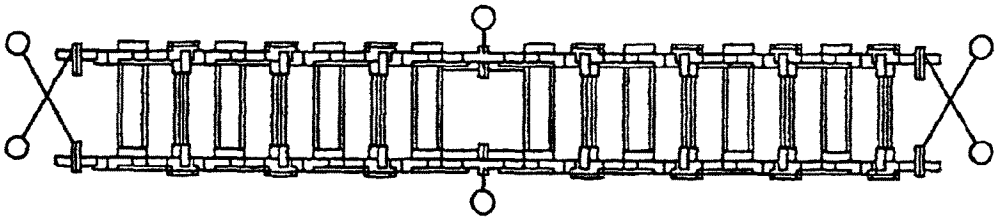
FIGS. 4A-4C are views of a security barrier according to one embodiment of this invention.
Figure 4A:
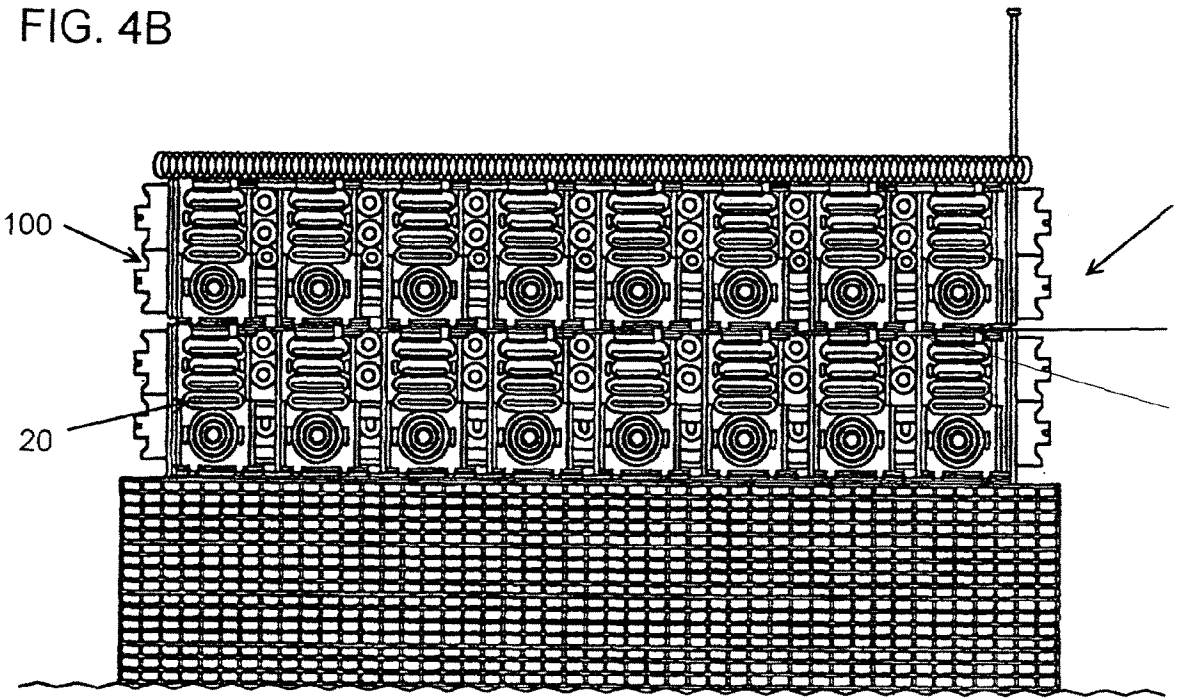
Figure 4C:
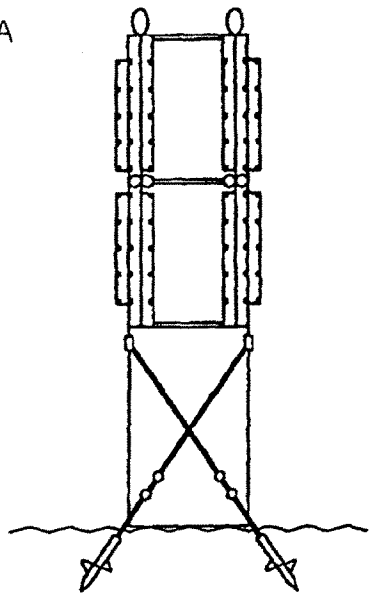
Figures 1, 2, 5A, 5B, 5C, 5D, 6A, 6B, 6C, 6D, 6E:
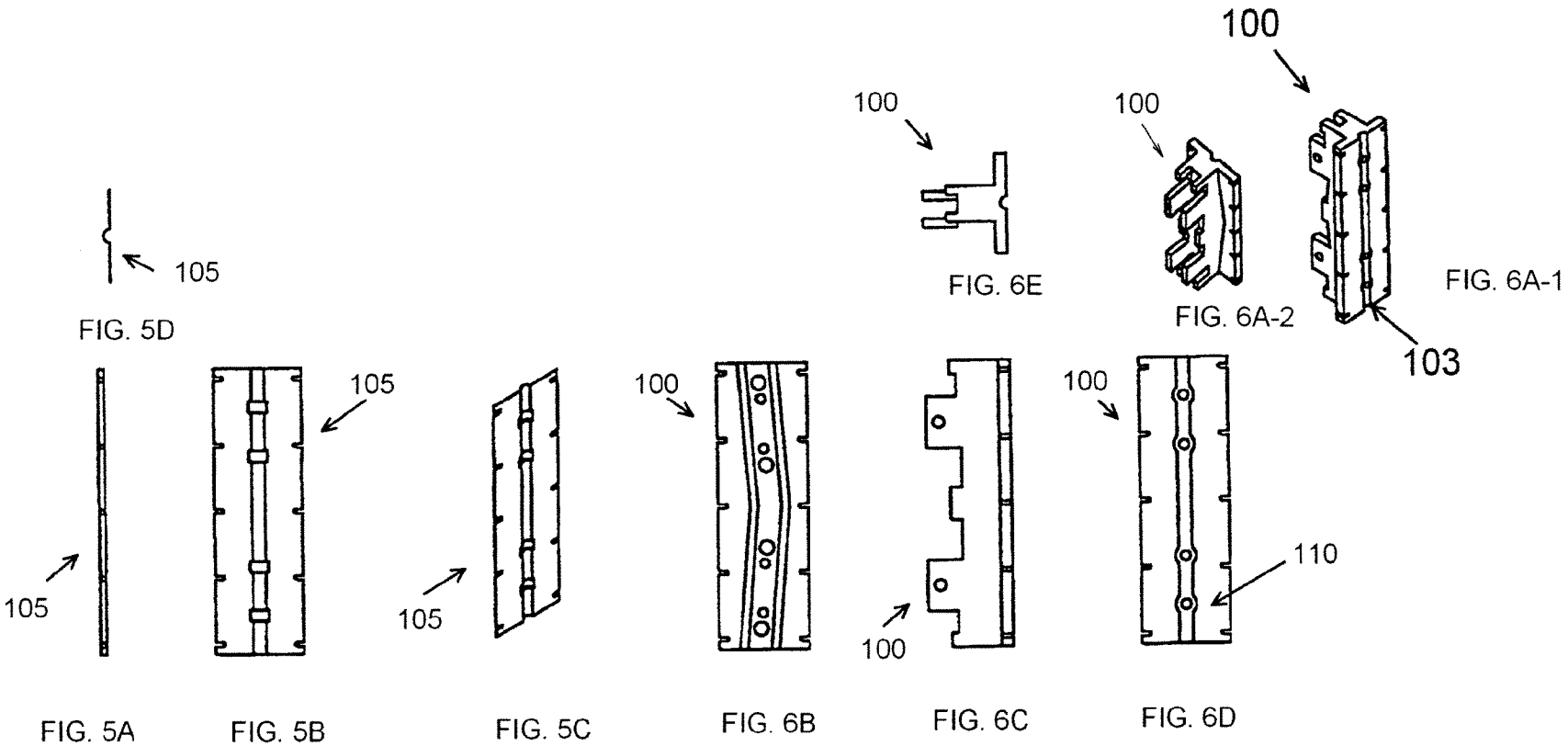
FIGS. 5A-5D are views of a butt plate according to one embodiment of this invention.
FIGS. 6A-6E are views of a topper according to one embodiment of this invention. Each of FIGS. 6A-1 and 6A-2 is schematic views of a topper.
Figure 7:
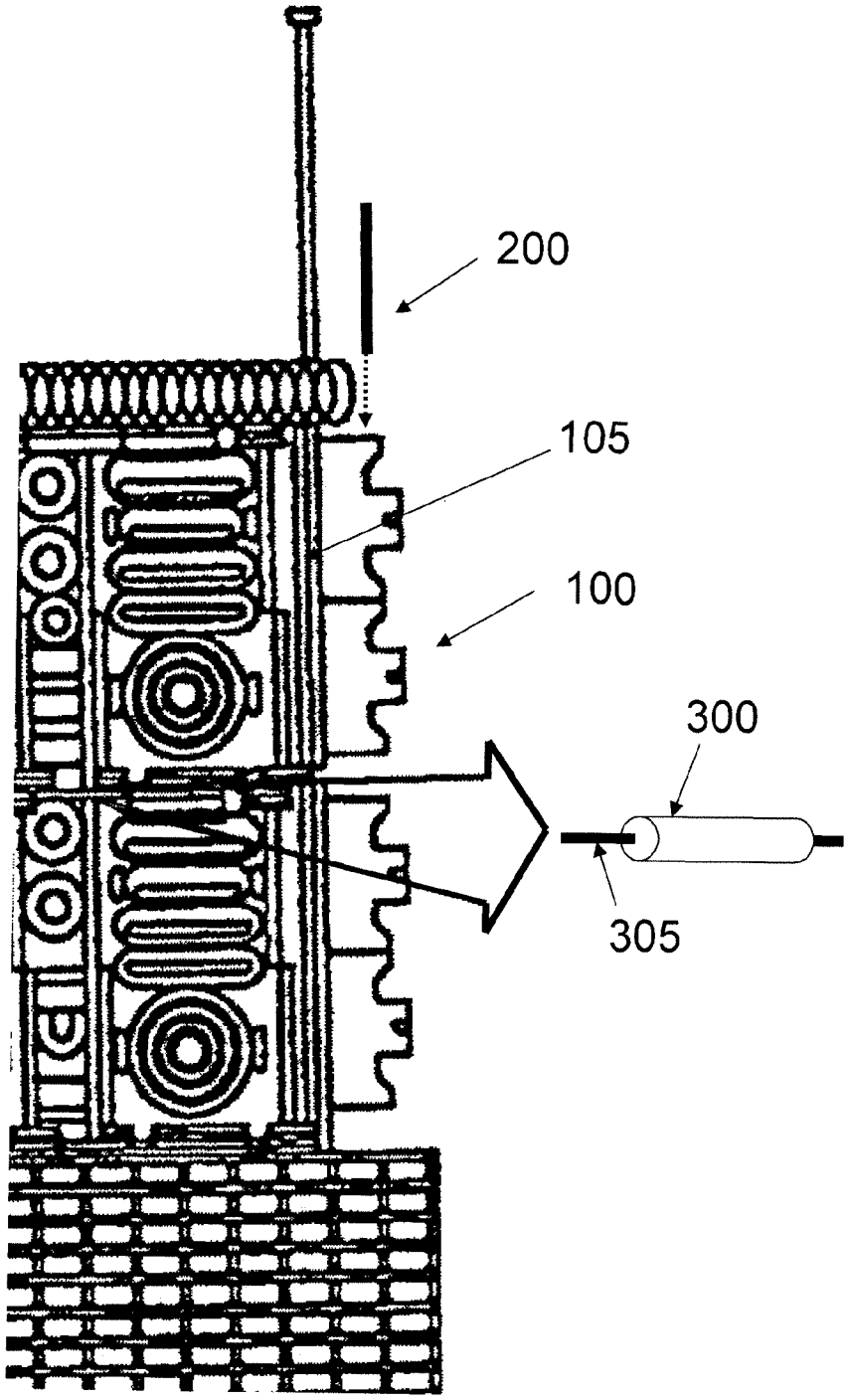
FIG. 7 is an enlarged view of an engaging portion of barrier units and individual panels.
Figure 8:
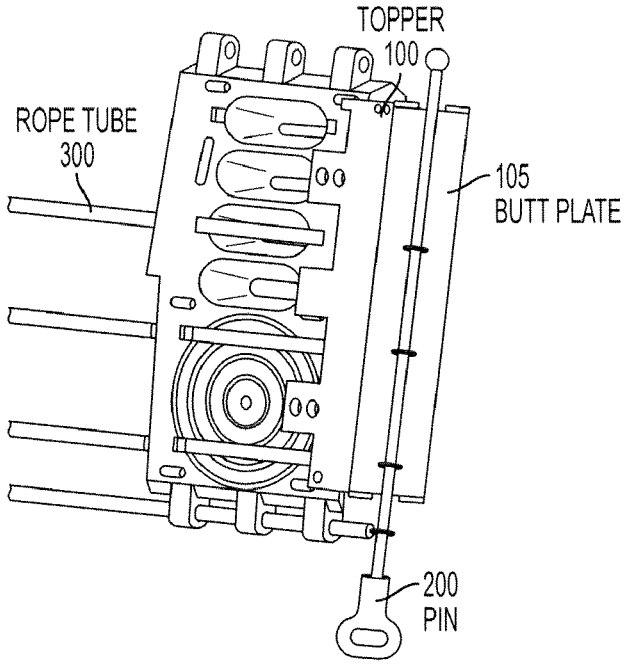
FIG. 8 is an enlarged view of an engaging portion of barrier units and individual panels.
Figure 9:
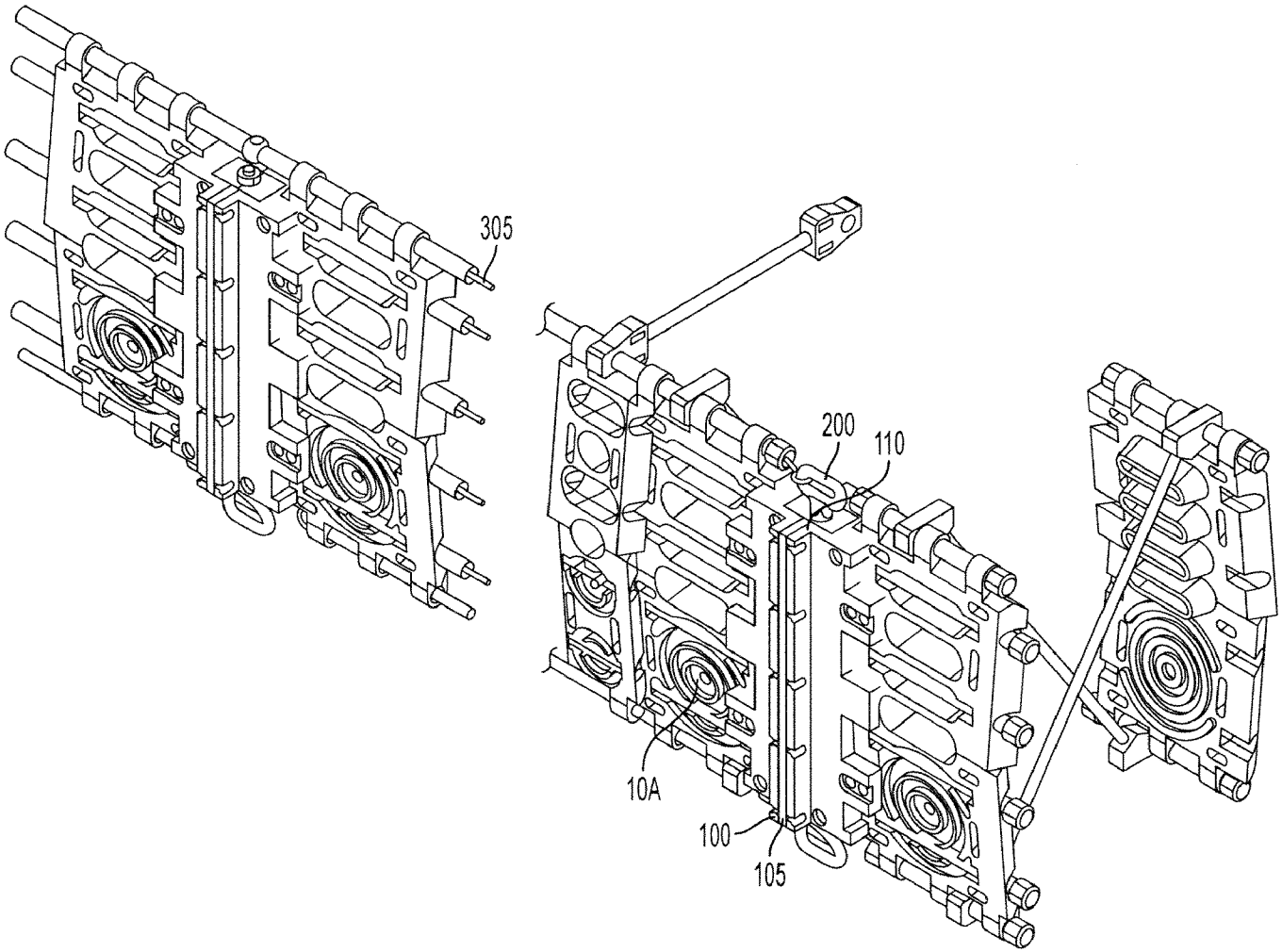
FIG. 9 is an enlarged view of an engaging portion of barrier units and individual panels.
Figure 10:
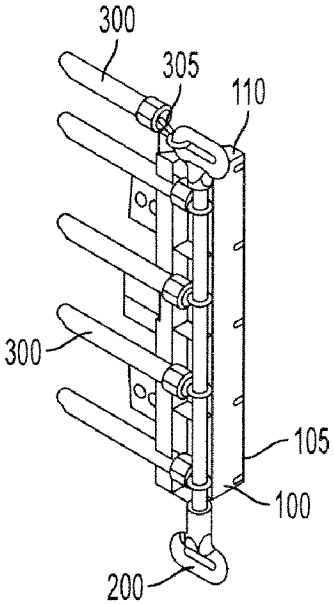
FIG. 10 is an enlarged view of an engaging portion of barrier units and individual panels.

In a preferred embodiment of this invention, a security system/barrier 10 for use in water comprises a top structure ("topper"), a vertical pin, a butt plate, a rope-containing tube ("rope tube"), and an individual panel.

Topper (Top Structure)

The topper 100 is a first component of the security barrier 10. The topper 100 comprises a composite plastic and steel structure designed to join permanently during regular wave activity or temporarily when a boat impacts the security barrier. The topper 100 has an internal cavity (a groove) 103 designed to accept a steel butt plate 105 and space to allow the storage of extra rope.

The topper maintains the structural integrity of a contiguous length of security barrier during normal and storm wave activity in the maritime environment.

When a boat impact occurs on the structure, a breakaway flange 110 on the topper 100 disengages individual security panel unit 10A from one another. This action allows rope contained in the topper internal cavity to be played out, thereby reducing initial impact forces on the security barrier and increasing the stroke of the barrier. Consequently, the security barrier experiences a controlled break.

By creating a controlled break, damage from a boat impact is limited to the topper and associated butt plate and anchor rod. Thus, the security barrier remains a viable boat barrier after impact.

Vertical Pin

A second component of the security barrier is a vertical pin 200. The vertical pin comprises a HDPE tube 205 and a stainless steel core 210.

The vertical pin 200 is preferably terminated with an anchor eye 215 on both ends the entire vertical pin assembly is placed within two topper panels 100 and two strong butt plates 105.

Within the vertical pin assembly, the anchor rod is passed down through eye splices or grommets of spectra fiber ropes. The vertical pin is used to arrest the ropes after they have played out within the HDPE tubing during an impact.

The vertical pin 200 is terminated on both ends with a stainless steel eye nut which prevents free movement through the topper and butt plates. The vertical pin 200 is preferably optimized to the anticipated impact force of a vessel striking the barrier. The pin may bend and lock into the topper 100 and the butt plate 105 under extreme loads with the load then being transferred to the anchor line and mooring system.

Butt Plate

Another component of the security barrier is the butt plate 105. The butt plate is comprised of stainless steel or other similar strength materials suitable for the marine environment; such materials are known in the relevant art. The butt plate serves as a structural member at the anchor points of the structure at the bottoms of topper panels.

The butt plate forms a vertical locking mechanism for securing anchor pins against normal pitch and heave from wave activity.

The butt plate is further comprised of internal compartments that are created for storing spectra fiber ropes. Each length of rope that is passed through the panels of the security panel has its own internal compartment. The compartments also provide crumple zones within the topper panels. Each compartment is designed to collapse during boat impact acting as a shock absorber for vertical forces pulling the vertical pin.

Rope Tube

The rope tube 300 is an additional component of the security barrier. The rope tube allows spectra rope 305 to act as a structural member in a boat barrier system.

The rope itself is one of the fiber types or combination ropes having high-strength properties and corrosion resistance; such ropes are well-known in the prior art.

The rope is secured to the security barrier in a way that increases the overall strength of the barrier. Preferably, portions of the rope are deployed in hollow plastic tubes. The plastic is preferably HDPE.

Consequently, a rope tube is composed of a plastic shell and a rope fiber core. The tube provides structural integrity for an encompassing security unit in normal and storm sea conditions independent of the rope.

The tube shrouds the rope contained within the tube protecting it from abrasion, UV light, and damage from animals. The rope contained within the tube is under no stress until a boat impacts the security barrier.

The ropes are only attached to the rope tubes at the ends of the rope tubes, preferably by a screw-top method. This attachment method permits the rope tube to be structurally joined to the security barrier itself Thus, the rope tube allows the rope to act as a structural member in the security barrier system.

In use, the rope while in the rope tube has some slack and is activated only when the elastic properties of the barrier system are reached.

When a boat or other intrusive object impacts the security barrier, the barrier panels and the plastic tubes move as one unit, commonly bending in a shape similar to a parabolic curve. When the elastic limit of the security unit panels and plastic tubes is reached, the ropes contained within the rope tubes are played out and put under tension. Once any rope is taut, that rope's ends are placed under a load, and that rope acts as an arrester cable stopping the boat's forward progress through the barrier.

Individual Panel

Another component of the security barrier is the individual panel 20. The individual panels 20 are comprised of strong plastic, preferably molded to the desired shape. The panels contain apertures and openings designed to channel water through them in a predetermined pattern based upon the particular application and, thereby, further dissipate the energy of impact with a boat. Some such panel designs are now well known in the relevant art due to previous inventions by this inventor.

Through the employment of unique spectra and other polymer fibers and materials, the individual security panels can be made blast resistant. The panels act as baffles to blast shockwaves. The panels minimize and redirect flow of explosions into the water trapped between the rows of the structure.

The individual panels will come into directly contact with any intruding boat, beginning the energy dissipation process.

In use, the topper and butt plate maintain the structural integrity of a contiguous length of security barrier during normal and storm wave activity in the maritime environment.

However, when a boat impact occurs on the security barrier, individual panels will come into directly contact with the intruding boat, beginning the energy dissipation process.

The breakaway flange on the topper disengages individual security panels from one another and the security barrier commonly bends into a shape similar to a parabolic curve. This action allows rope contained in the topper internal cavity to be played out, thereby reducing initial impact forces on the security barrier and increasing the stroke of the barrier.

When the elastic limit of the security barrier is reached, the ropes contained within the rope tubes are played out and put under tension. Once any rope is taut, that rope's ends are placed under a load, and that rope acts as an arrester cable stopping the boat's forward progress through the barrier.

The vertical pin is used to arrest the ropes after they have played out within the HDPE tubing during an impact.

The butt plate internal compartments act as crumple zones within the topper panels and collapse during boat impact. The compartments thereby act as shock absorbers for vertical forces pulling at the vertical pins.

Consequently, the security barrier experiences a controlled break. This controlled break limits damage from a boat impact to the topper and associated butt plate and anchor rod. Thus, the security barrier remains a viable boat barrier after impact.

Further, instead of damage occurring in the middle of the barrier—or to a part where replacement of components is difficult and would incur an extended period of time until repair is done—damage occurs where it is far easier and quicker to repair. Repair consists of replacing topper components at the end of a panel.

Another embodiment of this invention comprises a security barrier with a plurality of rows connected by horizontal pins in the topper. The horizontal pins are similar in structure to the vertical pins described above. However, these horizontal pins are deployed in a horizontal direction relative to the barrier's rows.

In this embodiment, to minimize the effects of impact and blast upon the security barrier, a gap or space is provided between each pair of adjoining rows of the barrier. These spaces serve as buffers between rows of the structure as well as providing cushions of water which absorb blast energy and the transfer of energy from a vessel impact.

The volume of water trapped between the rows of the structure is variable depending on the spacings between rows of the structure. More separation equals greater mass of water to absorb the shock of vessel impact and/or explosions. Thus, the water counteracts the forces of blast and vessel impact in a direct relationship with that mass of water.

In still another embodiment of this invention, a flexible mooring system provides additional survivability of the security barrier.

The ability of the mooring to absorb some of the shock load of a vessel impact helps with the survivability.

The security barrier is adaptable to use of various moorings. A preferred type of mooring is a cluster of elastomer hawsers tied together to form a flexible component in a mooring line. This mooring system is capable of 100% elongation. Such extensive elongation helps waterborne structures, such as the security barrier, accommodate tidal fluctuations and storm events while under tension.

Regarding the security barrier, this mooring system allows the barrier to recoil through its elongation, thereby providing significant shock absorption.

The security barrier may also act as a wave attenuator. As such, the barrier has the capability to reduce the wave activity in the lee of its structure. This decreases turbulence and noise in the water under normal conditions.

A major benefit of this calming of the waters is the creation of an acoustic "shadow" or an area where the water is much quieter. In this quiet region, acoustic sensor and transducers may be placed on the sea floor or in the water column to detect underwater intrusion by man or machine. Similar sensors may also be placed on the security barrier itself.

This acoustic "shadow" effect will be very helpful in the littoral environment in shallower waters where it can be very difficult to detect swimmers and autonomous underwater vehicles.

This use of the barrier provides another significant improvement over the prior art.

Therefore, although this invention has been described with a certain degree of particularity, it is to be understood that the present disclosure has been made only by way of illustration, and that numerous changes in the details of the apparatus and method may be resorted to without departing from the spirit and scope of the invention.

What is claimed is:

1. A security barrier for use in a water location, the security barrier comprising:

a plurality of barrier units, each barrier unit comprising:

a plurality of individual panels, and a rope tube containing a rope connecting said plurality of individual panels;

toppers disposed between adjacent barrier units of the plurality of barrier units;

a butt plate attached between the toppers disposed between adjacent barrier units;

a vertical pin connecting toppers disposed between adjacent barrier units to the butt plate by being placed within the toppers and butt plate, wherein the toppers disposed between adjacent barrier units connect the adjacent barrier units to one another and are configured to disengage the adjacent barrier units from one another when an impact occurs on the security barrier, and wherein an end of each rope of adjacent barrier units is engaged with the vertical pin so that the plurality of individual panels, the toppers and the butt plate are secured to each other such that upon impact to the security barrier, the toppers disengage the plurality of barrier units from each other and the rope within the rope tubes are played out and put under tension such that the rope acts as an arrester cable.

2. The security barrier of claim 1, wherein each of the toppers includes a breakable flange for disengaging an adjacent barrier unit.

3. The security barrier of claim 2, wherein each of the toppers includes a groove on which the butt plate is disposed and contacts.

4. The security barrier of claim 1, wherein the vertical pin comprises:

a tube; and a core terminated with anchor eyes at both ends of the core.

5. The security barrier of claim 1, wherein each of the individual panels includes a plurality of through-holes.

* * * * *